United States Patent [19]

Swartzbaugh

[11] 4,282,983

[45] Aug. 11, 1981

[54] CONTAINER WITH IMPROVED SPRING-LIKE HINGE

[75] Inventor: Peter T. Swartzbaugh, Toledo, Ohio

[73] Assignee: Owens-Illinois, Inc., Toledo, Ohio

[21] Appl. No.: 167,991

[22] Filed: Jul. 14, 1980

[51] Int. Cl.[3] ..... B65D 43/24

[52] U.S. Cl. ..... 220/335; 220/338; 220/337; 16/128 R; 16/171

[58] Field of Search ..... 220/335, 337, 338, 340; 16/128 R, 171

[56] References Cited

U.S. PATENT DOCUMENTS

| | | | |
|---|---|---|---|
| 2,732,581 | 1/1956 | Heck | 220/338 |
| 2,733,830 | 2/1956 | Ruskin | 220/338 |
| 2,734,222 | 2/1956 | Kiba | 16/128 R |
| 3,333,726 | 8/1967 | Belanger | 220/337 |
| 4,158,902 | 6/1979 | Chernack et al. | 220/335 |

*Primary Examiner*—George T. Hall

*Attorney, Agent, or Firm*—Thomas L. Farquer; Myron E. Click; David H. Wilson

[57] ABSTRACT

A plastic container for storing articles such as surgical pads, gauze pads or bandages comprising a generally rectangular, upstanding hollow main body and a hinged closure. The main body includes at least one slotted portion along the rear wall with an irregularly shaped crossbar extending there across. A plastic, generally rectangular, hollow closure is attached to the main body by a hinge of complementary geometry to the crossbar. The hinge includes at least one straight rigid downwardly depending leg spaced apart from a hinge back. The hinge back includes a downwardly depending flexible web portion terminating in a jaw-like inwardly curving crossbar engaging portion.

10 Claims, 6 Drawing Figures

CONTAINER WITH IMPROVED SPRING-LIKE HINGE

BACKGROUND OF THE INVENTION

1. Field of the Invention

The present invention relates generally to a storage container for medical supplies, for example, surgical bandages, adhesive strips, gauze pads and the like. More particularly, the invention relates to a new hinge mechanism with a spring-like action to lock the closure in the open or closed position.

2. Description of the Prior Art

The prior art is replete with examples of hinged container configurations. Typically, prior art container structures have included a generally rectangular, hollow main body portion and a closure wherein the closure is secured to the main body portion by a hinge mechanism.

One style of hinge mechanism is exemplified by U.S. Pat. No. 2,492,864 which discloses a bead on the closure engaging a hollowed out complementarily shaped spaced in the main body to allow a pivot action.

Another style of closure is exemplified by U.S. Pat. Nos. 3,966,083 and 3,451,580. These patents disclose hinge mechanisms wherein hollow sleeves are disposed about the upper margin of one member of the container while hinge pins are disposed about the upper margin of the second member of the container. The pins are journaled into the sleeves to allow fastening of the closure to the main body and pivoting of one part relative to the other.

Another style of hinge is exemplified by U.S. Pat. Nos. 2,637,460, 2,605,926 and 2,642,987. These patents exemplify a style of hinge wherein hinge pins are snapped into jaw-like arms on a closure. The jaw-like arms pivot about the hinge pins to allow movement of the closure relative to the main body.

Yet another style of hinge mechanism is exemplified by U.S. Pat. No. 2,733,830 which discloses a main body having a plurality of regularly shaped holes along its upper margin which accept legs attached to the rear closure wall, thereby allowing the closure to pivot about the upper portion of the main body.

The above-described structures typically must be associated with a special and discrete structure on the container which locks the closure in the open or closed position relative to the main body. The design and molding of such special locking means is expensive and adds to the cost of the container in an industry where slight advantages in price contributes substantially to the commercial success of the container.

Accordingly, it is an object of the present invention to provide a hinged closure wherein the hinge mechanism includes a locking feature.

It is a further object of the invention to provide a hinge and crossbar assembly having sufficient structural rigidity to lock the closure in the open or closed position and still have sufficient flexibility to allow the spring-like movement of the hinge from the locked-open to the locked-closed position.

It is another object of the invention to provide an improved storage container which includes a spring-like, flexible portion of a hinge mechanism which cooperates with and complements a rigid position holding hinge portion.

It is still another object of the present invention to provide a storage container which is simply fabricated from a single material and comprises only two parts.

Accordingly, the present invention comprises a bipartite container including a main body and a hinged closure. The main body is generally rectangular in shape and hollow. Spaced along the upper margin of the rear wall of the main body is at least one slot which extends into the rear wall of the main body. An irregularly shaped crossbar bridges the slot and provides a mounting for the hinge portion which is attached to the closure. The hinge is attached to the rear wall of the closure and includes a tripartite structure. Located at the top of the closure is a hinge back which includes a downwardly depending flexible web terminating in an inwardly curving jaw section. Spaced apart from and aligned with the hinge back is at least one downwardly depending flat surfaced leg.

BRIEF DESCRIPTION OF THE DRAWINGS

The above as well as other objects and advantages of the invention will become readily manifest to those skilled in the art from reading the following detailed description of a preferred embodiment of the invention when considered in view of the accompanying drawings in which.

DESCRIPTION OF THE PREFERRED EMBODIMENTS

Figure 1:
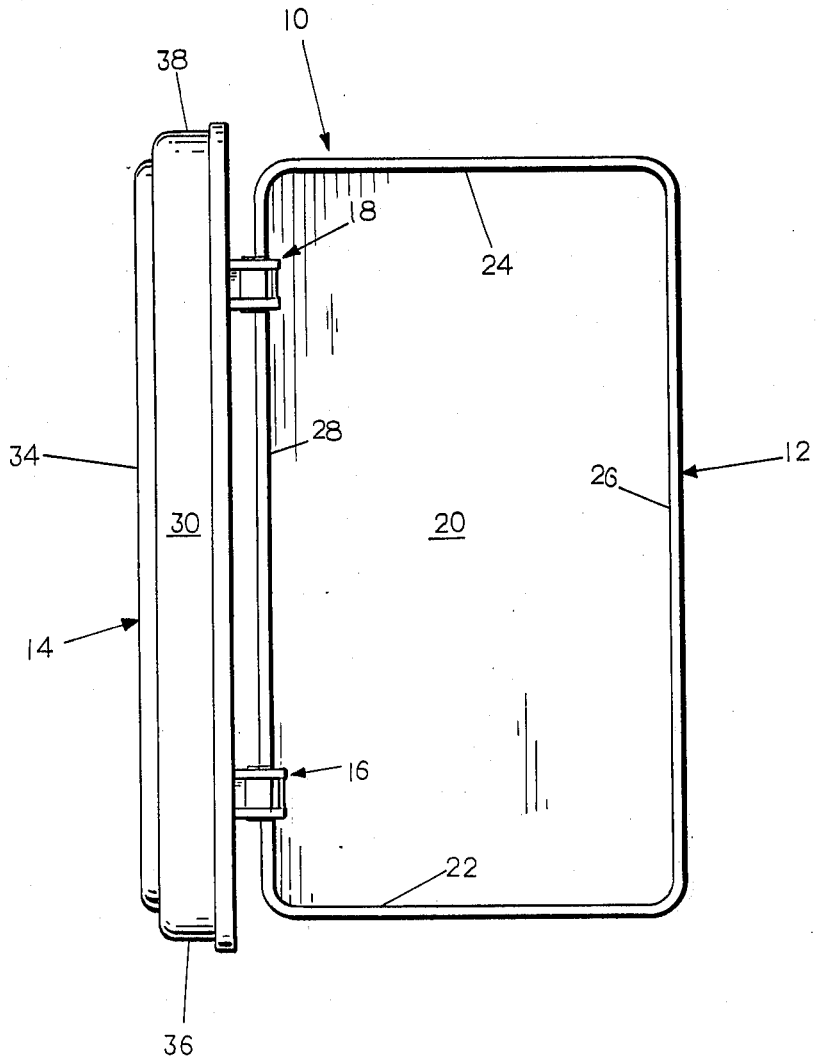
FIG. 1 is a top plan view of the present invention illustrating the closure in the locked-open position.
Figure 2:
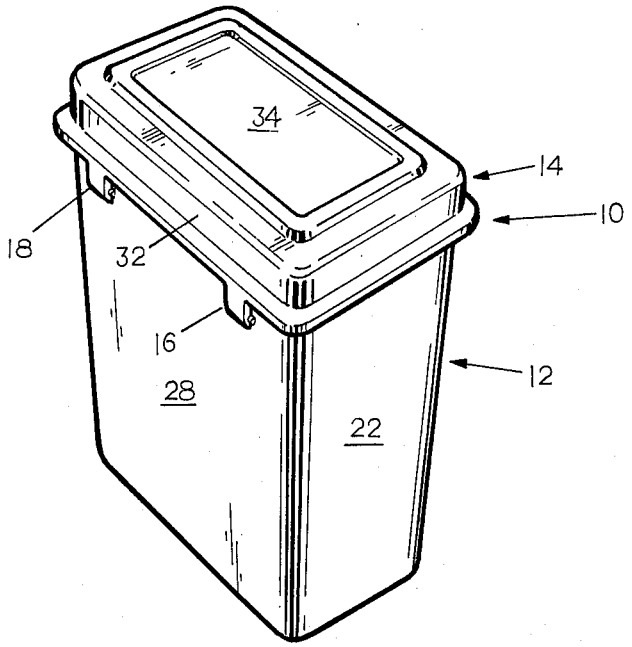
FIG. 2 is a perspective view of the present invention showing the closure in the locked-closed position.

Referring to the above-described drawings, and particularly FIGS. 1 and 2, the present invention comprises a plastic container 10 which includes a main body 12, a closure 14 and a pair of hinge elements 16 and 18, respectively, which hinge elements 16 and 18 attach the closure 14 to the main body 12. The hinge elements 16 and 18 allow the closure 14 to pivot toward and away from the container for engagement with the main body 12 to form a selectively openable and closable container 10.

The main body 12 includes a generally flat bottom wall 20 and an upright perimeter wall comprised of a pair of upstanding, spaced apart, flat side walls 22 and 24, respectively, a flat front wall 26 and a flat rear wall 28. The front wall 26, rear wall 28, and side walls 22 and 24 are secured to one another and to the bottom wall 20 to form a generally rectangular, hollow, open-ended container 10 which is a preferred shape of the container 10, but need not be the only possible shape. Any suitable shape of the main body 12 and the closure 14 may be employed provided that the shapes are peripherally engageable or one overlaps with the other to form a closed container suitable for storing bandages and the like. In the event the container 10 is used for storing environmentally sensitive items, such as medications, the upper edge of the perimeter wall may include a gasket (not shown) to diminish environmental exchange from inside to outside of the container 10.

The closure 14 includes a front wall 30, a rear wall 32, a top wall 34 and a pair of spaced apart side walls 36 and 38, respectively, all said walls being generally flat. The closure 14 as illustrated in FIGS. 1 and 2 is complementary in shape to the main body 12 and is, accordingly, generally rectangular, hollow and open-ended. As above, any suitable shape of closure 14 may be employed to practice the invention if said closure shape is complementary to the shape of the main body 12.

Figure 4:
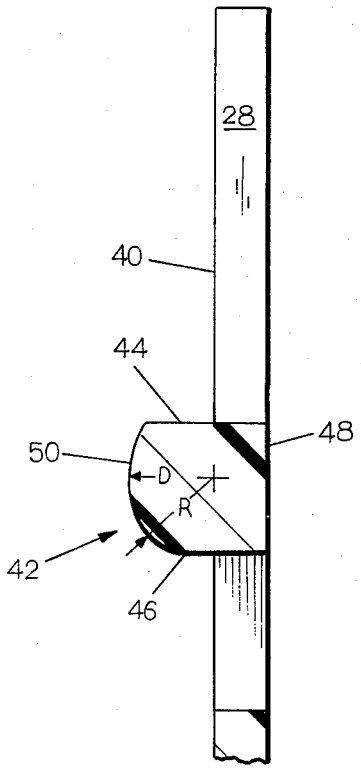
FIG. 4 is a fragmentary side elevational view of the irregularly shaped crossbar.
Figure 3:
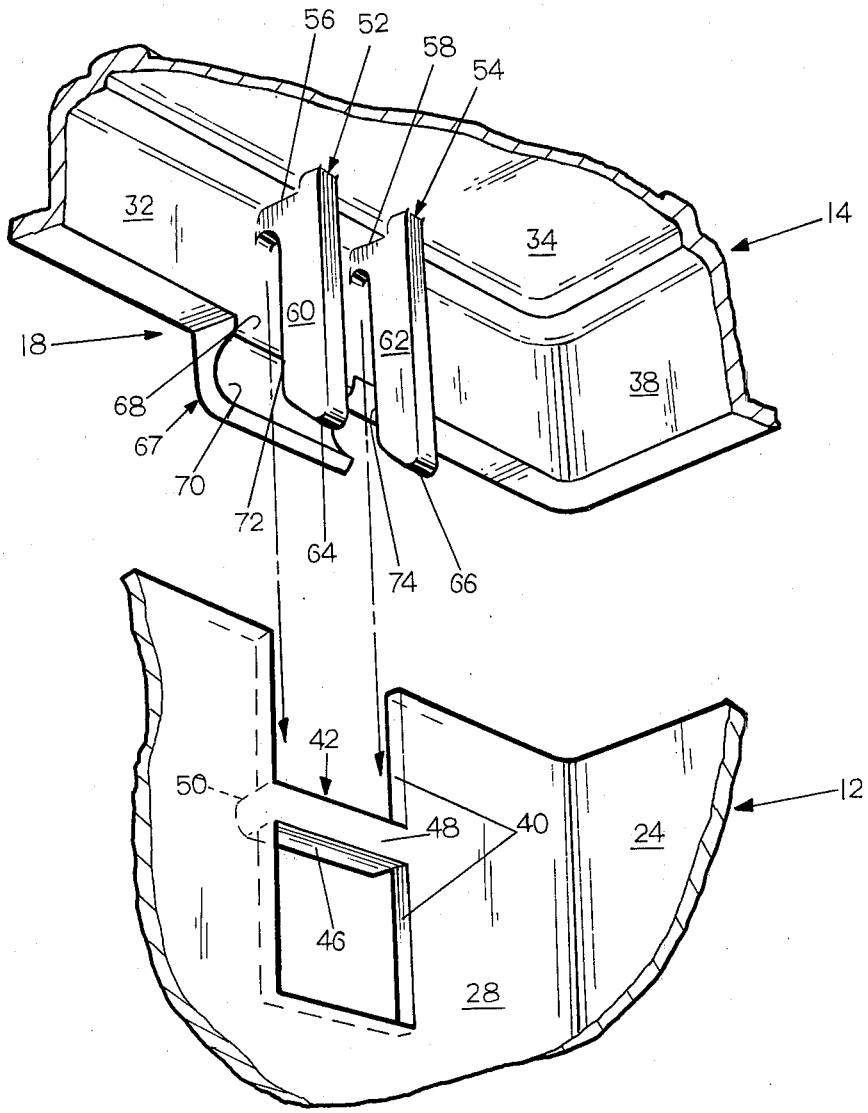
FIG. 3 is a fragmentary perspective view of the hinge and crossbar assembly of the present invention.

As illustrated in FIGS. 3 and 4, a hinge element, for example, hinge element 18 according to the present invention, is defined as follows. Spaced along the rear wall 28 of the main body 12 of the container 10 is a slotted portion 40 which has extending there across a shaped solid crossbar 42. As best shown in FIG. 3, the shaped solid, rigid crossbar includes a flat top surface 44, a flat bottom surface 46, a flat inner or inboard surface 48 and a curved outboard or outer surface 50. The curved outboard wall exhibits a radius of curvature $R_1$ and has its outboard surface 50 spaced apart from the inboard surface 48 a distance $D_1$. In appearance the surface 60 is a convex semicircular shape which may be described as generally C-shaped.

A complementarily shaped portion of the hinge element 18 is disposed along the rear wall 32 of the closure 14 and is placed in registry with the slotted portion 40 of the main body 12. The portion of the hinge element 18 disposed on the closure 14 includes a pair of generally inwardly extending legs, including a first leg 52 and a second leg 54. The legs 52 and 54 are secured to the rear closure wall 32 by web posts 56 and 58 which merge into downwardly depending hinge ribs 60 and 62. Each rib, 60 and 62, respectively, terminate in inwardly beveled rib ends 64 and 66. Disposed outboard of the first and second legs, 52 and 54, respectively, is a jaw assembly 67 which includes a flexible jaw web 68 which terminates in a downwardly depending, inwardly curving, generally C-shaped jaw 70. The inboard surface of the jaw 70 is spaced apart from outboard rib walls 72 and 74, respectively, by the distance $D_1$ (FIG. 4) and the jaw 70 exhibits a radius of curvature $R_1$ substantially identical to the radius of curvature $R_1$ of the curved surface 50 of the crossbar 42.

Figure 5:
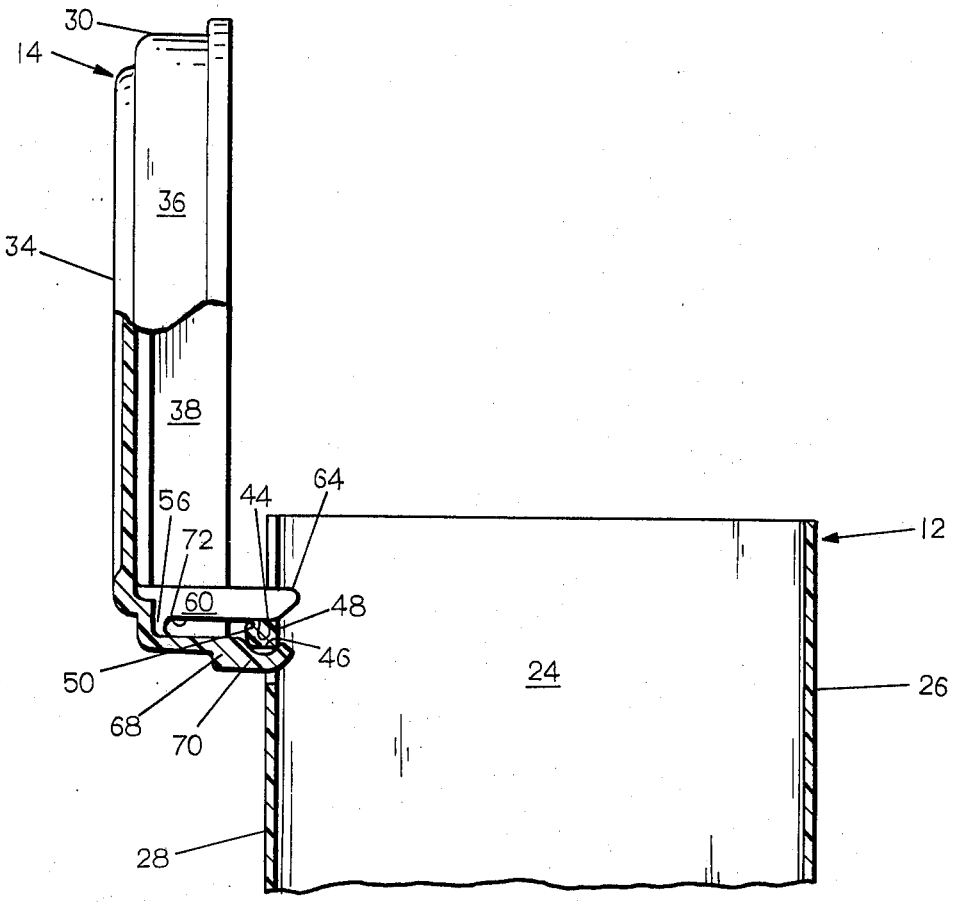
FIG. 5 is a partial sectional view of the closure in the locked-open position.
Figure 6:
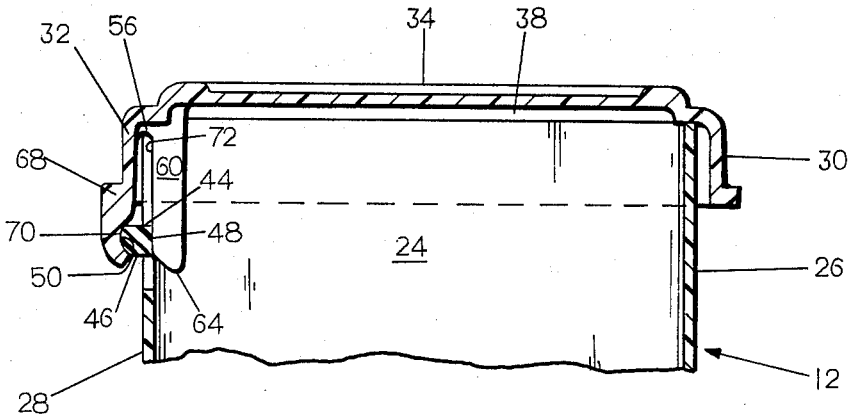
FIG. 6 is a partial sectional view of the closure in the locked-closed position.

FIGS. 5 and 6 illustrate the operative relationship between the crossbar 42 and the leg and jaw assembly 60, 62 and 70, respectively.

In operation, and as best shown in FIG. 3, the closure 14 is disposed above the main body 12 so that the inboard surfaces 72 and 74, respectively, of the legs 60 and 62, respectively, are in registry with the inboard surface 48 of the crossbar 42. Similarly, and simultaneously, the jaw 70 is in registry with the outboard surface 50 of the crossbar 42. To engage the closure 14 with the main body 12, the closure is forced onto the main body so as to cause the crossbar 42 to slide past the beveled ends 64 and 66, respectively, of the legs 60 and 62 and into the space defined by the inboard surfaces 72 and 74 of the legs 60 and 62 and the inboard surface of the jaw 70. As the crossbar is forced into the above-described space, the web 68 of the jaw assembly 67 and the webs 56 and 58 of the legs 60 and 62 allow enough flexibility to the structure to allow the crossbar 42 to be forced into the space between the outboard surfaces 72 and 74 of the legs 60 and 62 and the inboard surface of the jaw 70 so as to snap the crossbar 42 into its proper orientation with respect to the closure 14. The resultant structure is most clearly illustrated in FIG. 6.

In operation, the flexible webs 56, 58 and 68 permit the crossbar 42 to be snapped into the space provided for it and then cause the legs 60 and 62 and jaw 70 to frictionally engage the crossbar 42 to hold it in the preferred orientation for the closure 14 in the locked-closed position. An important feature of the present invention resides in the operative nature of the structure disclosed wherein once the crossbar 42 is properly placed in the hinge elements 16 and 18 located on the closure 14, the closure is locked in the closed position due to the frictional engagement of the complementary curved surfaces 50 and 70 and of the complementary flat surfaces 48, 72 and 74.

To open the closure 14, as illustrated in FIG. 5, the front of the closure is pivoted upwardly and toward the rear of the main body 12. As this action occurs, the webs 56, 58 and 68 allow, under the force of the pivoting motion, the curved jaw 70 to disengage the outboard curved surface 50 of the crossbar 42 and allow the closure 14 to be moved to the open position. In the open position, the webs 56, 58 and 68 once again cooperate to frictionally engage the closure 14 in a locked-open position. The inboard surfaces 72 and 74 of the legs 52 and 54 are engaged with the flat top surface 44 of the crossbar 42 while the curved jaw 70 is forced into frictional engagement with the bottom flat wall 46 of the crossbar 42 under the influence of the flexible webs 56, 58 and 68. The frictional engagement of the surfaces described above locks the closure in the open position against reasonable forces which may be applied to the closure 14. When it is desired to close the closure 14 and thereby bring it into closed engagement with the main body 12, sufficient force is applied to the closure 14 to cause the closure 14 to pivot about the crossbar 42 by overcoming the locking force imposed by the flexible webs 56, 58 and 68. Once the closure 14 is engaged with the main body 12, the flat surface 48 engages the flat surfaces 72 and 74 while the outboard curved crossbar surface 50 engages the complementarily curved wall of the jaw 70, thereby once again locking the closure 14 in the closed position.

While the invention has been described with the legs 52 and 54 inboard of the crossbar 42 and the jaw 70 outboard of the crossbar 42, this configuration may be reversed by reversing the shape of the crossbar and the placement of the jaw 70 and the legs 52 and 54.

Similarly, while in the preferrred embodiment illustrated in the drawings, two hinge elements 16 and 18 are illustrated, one or more hinge elements may be employed in a suitable fashion to employ the invention.

Typically, containers according to the present invention are fabricated from thermoplastic polymers which impart to the webs 56, 58 and 68 sufficient flexibility to allow pivotal motion of the closure 14 with respect to the main body 12 yet provide sufficient resiliency to allow the locked-in position of the closure 14 with respect to the main body 12 to be maintained. Such thermoplastics are polystyrene, polyethylene or polypropylene and other similar thermoplastic materials.

In another embodiment, a slot similar to the slot 40 and crossbar similar to the crossbar 42 may be employed which extend across substantially all of the rear wall 28 of the main body 12. In this embodiment, any number of hinge assemblies, like the hinge assembly 18, may be spaced along the closure 14 to facilitate the invention.

In yet another embodiment, a pair of crossbars similar to the crossbar 42 may be attached to the upper rear wall of the side walls 22 and 24, respectively, of the main body 12 such that they extend perpendicular to the walls 22 and 24. Appropriate complementary hinge elements are secured to the side walls 36 and 38 of the closure 14 for engagement with such crossbars.

In accordance with the provisions of the patent statutes, I have explained the principle and mode of operation of the invention, and have illustrated and described in the preferred and alternative embodiments what I consider to be the best embodiments of the invention. It will be understood that, within the scope of the appended claims, the invention may be practiced otherwise than is specifically illustrated and described in the above embodiments.

I claim:

1. A container comprising:

a shaped hollow main body portion open at one end and having spaced apart front, rear, bottom and side walls, at least one slot extending downwardly from the upper edge of said rear wall;

a shaped crossbar extending across said slot and including a flat front surface adjacent to said rear main body wall, a flat upper surface extending outwardly and perpendicularly from said rear main body wall, a curved rear surface extending downwardly from said flat upper surface, and a flat bottom surface extending between said curved rear surface and said front flat surface;

a matching shaped hollow, hinged closure portion including spaced apart front, rear, bottom and side walls, for closing said hollow main body portion including;

at least one hinge means for engaging said crossbar having a bipartite structure including a flexible rear leg web depending downwardly from the rear wall of said closure, said rear leg terminating in a curved jaw complementary to said curved rear crossbar surface and in registry therewith; and a rigid flat surfaced front leg spaced inwardly from said curved jaw of said rear leg wherein said front leg and said curved jaw of said rear leg are spaced apart a distance equal to the distance from said flat front crossbar surface to said rear curved crossbar surface.

2. The invention defined in claim 1 wherein said container is fabricated of polystyrene.

3. The invention defined in claim 1 wherein said container is fabricated of polyethylene.

4. The invention defined in claim 1 wherein said container is fabricated of polypropylene.

5. The invention defined in claim 1 wherein said curved rear surface of said shaped crossbar is a convex semicircle.

6. The invention defined in claim 1 wherein said container is generally rectangular in shape.

7. The invention defined in claim 1 wherein said rigid, flat surfaced front leg includes a pair of spaced apart leg panels having beveled ends.

8. The invention defined in claim 1 wherein said rigid, flat surfaced front leg of said hinge means is secured to said closure by a flexible front leg web.

9. The invention defined in claim 7 wherein each of said spaced apart leg panels is secured to said closure by a flexible front leg web.

10. A hinge assembly for a two-part container having a body and a lid comprising:

a first hinge element including an elongate, rigid shaft having a first and second end, having a flat front surface, a flat top surface, a flat bottom surface and a C-shaped rear surface spaced apart from said front surface by a distance $D_1$ and having a radius of curvature $R_1$;

means on each said first and second end of said rigid shaft to secure said shaft to and space said shaft apart from said container body;

a second hinge element including a rigid, elongate first member depending downwardly from said lid and having a generally rectangular, cross-sectional area in registry with said first hinge element; and a second member depending downwardly from said lid and having a flexible first portion and terminating in a generally C-shaped jaw portion corresponding with said C-shaped rear surface having a radius of curvature $R_1$, said jaw portion spaced apart from said first member a distance $D_1$.

* * * * *